US008109844B1

(12) United States Patent
Quinn

(10) Patent No.: US 8,109,844 B1
(45) Date of Patent: Feb. 7, 2012

(54) BALL TEE FOR BATTING PRACTICE

(75) Inventor: Thomas A. Quinn, Carlsbad, CA (US)

(73) Assignee: Pro Performance Sports, L.L.C., Carlsbad, CA (US)

( * ) Notice: Subject to any disclaimer, the term of this patent is extended or adjusted under 35 U.S.C. 154(b) by 0 days.

(21) Appl. No.: 12/862,095

(22) Filed: Aug. 24, 2010

(51) Int. Cl.
*A63B 69/00* (2006.01)
*A63B 71/00* (2006.01)

(52) U.S. Cl. ..... 473/417; 473/422

(58) Field of Classification Search ..... 473/417, 473/422, 419, 452, 451, 387, 388, 399
See application file for complete search history.

(56) References Cited

U.S. PATENT DOCUMENTS

| | | | | | |
|---|---|---|---|---|---|
| 2,272,765 | A | * | 2/1942 | Beeson et al. | 473/417 |
| 2,976,041 | A | * | 3/1961 | White | 473/417 |
| 3,039,770 | A | * | 6/1962 | Ferretti | 473/454 |
| 3,183,000 | A | * | 5/1965 | Dix | 473/417 |
| 3,874,662 | A | * | 4/1975 | Harrington | 473/417 |
| 3,877,697 | A | * | 4/1975 | Lersch | 473/417 |
| 4,176,838 | A | | 12/1979 | Griffin | |
| 4,227,691 | A | | 10/1980 | Lefebvre et al. | |
| 4,364,563 | A | * | 12/1982 | Stafford | 473/417 |
| 4,383,686 | A | | 5/1983 | Cardieri | |
| 5,004,234 | A | | 4/1991 | Hollis | |
| 5,386,987 | A | | 2/1995 | Rodino, Jr. | |
| 5,772,536 | A | * | 6/1998 | Wang | 473/417 |
| 6,045,462 | A | * | 4/2000 | Mourek | 473/417 |
| 6,146,289 | A | * | 11/2000 | Miller et al. | 473/417 |
| 6,238,307 | B1 | * | 5/2001 | Owen | 473/417 |
| 6,358,163 | B1 | * | 3/2002 | Tanner | 473/417 |
| 6,398,671 | B1 | * | 6/2002 | Rios | 473/417 |
| 6,551,204 | B1 | * | 4/2003 | Di Re | 473/417 |
| 6,616,554 | B2 | * | 9/2003 | Liao | 473/417 |
| 7,204,769 | B2 | * | 4/2007 | Bandimere et al. | 473/417 |
| 7,479,074 | B1 | | 1/2009 | Pierce | |
| 7,704,168 | B1 | * | 4/2010 | Hochberg | 473/417 |
| 2006/0035729 | A1 | * | 2/2006 | Wang | 473/417 |
| 2006/0258485 | A1 | * | 11/2006 | Bandimere et al. | 473/417 |
| 2006/0264273 | A1 | * | 11/2006 | Liao | 473/417 |
| 2007/0049426 | A1 | * | 3/2007 | Huang | 473/417 |
| 2008/0085787 | A1 | * | 4/2008 | Molloy et al. | 473/417 |
| 2009/0029803 | A1 | * | 1/2009 | Lincoln | 473/417 |
| 2009/0312123 | A1 | * | 12/2009 | Liao | 473/417 |
| 2010/0056306 | A1 | * | 3/2010 | Chen | 473/417 |
| 2010/0311524 | A1 | * | 12/2010 | Lay | 473/417 |
| 2011/0092317 | A1 | * | 4/2011 | Burgess | 473/417 |
| 2011/0136593 | A1 | * | 6/2011 | Keller et al. | 473/417 |
| 2011/0183781 | A1 | * | 7/2011 | Chiu | 473/417 |
| 2011/0183782 | A1 | * | 7/2011 | Wang | 473/417 |
| 2011/0190079 | A1 | * | 8/2011 | Guevara | 473/417 |

* cited by examiner

*Primary Examiner* — Mitra Aryanpour
(74) *Attorney, Agent, or Firm* — Kenneth H. Ohriner; Perkins Coie LLP

(57) ABSTRACT

A ball tee for batting practice has a flexible base. A receiver is attached to the base and may rotate forward relative to the front of the base. A substantially rigid first tube is attached to or inserted into the receiver. A substantially rigid second tube is similarly attached to the first tube. The combined length of the first and second tubes may be adjustable. A flexible ball holder is attached to an upper end of the second tube. A cup may be provide at the top end of the ball holder. The receiver may be positioned closer to the back end of the base than to front end of the base. The base may have a flex section of reduced thickness which allows the receiver to rotate forward when the tee is struck by a bat. The ball tee tends to automatically return to an upright position after being hit by a bat.

19 Claims, 3 Drawing Sheets

BALL TEE FOR BATTING PRACTICE

BACKGROUND

A batting tee is used by baseball players to practice hitting baseballs held at various positions within or near the strike zone. By using a batting tee to practice hitting a stationary ball, players can improve their batting swings and learn to hit balls from various locations within and near the strike zone. If the player swings the bat too low, as often happens, the bat hits the tee. The batting tee is consequently subjected to repeated impacts by the bat, which may damage the batting tee. The batting tee may also tip over when hit with a bat. This interrupts the batting practice since the user must then pick up and reset the batting tee. The batting tee should also be easily portable and quick to set up and take down. It should also be adjustable to hold the ball over a range of desired heights.

Various batting tees have been proposed in the past. Generally these batting tees have a flat base or plate, an adjustable length post on the plate, and a ball holder at the top end of the post. Examples are shown in U.S. Pat. No. 4,227,691, U.S. Pat. No. 5,386,987 and U.S. Pat. No. 6,358,163. While these and other designs may have met with varying degrees of success, certain disadvantages remain. One disadvantage is the tendency of batting tees to fall over when hit with a bat. Another disadvantage is the tendency of batting tees to come apart, or to sustain permanent damage over time, from repeated bat impacts. Accordingly, it is an object of the invention to provide an improved batting tee.

SUMMARY OF THE INVENTION

An improved batting tee has now been invented. In one aspect, this new batting tee has a flexible base. A receiver is attached to the base and can bend relative to the base. A substantially rigid first tube is attached to the receiver, and a substantially rigid second tube is attached to the first tube. The combined length of the first and second tubes may be adjustable. A flexible ball holder is attached to an upper end of the second tube. A cup may be provide at the top end of the ball holder. In second aspect, the receiver is closer to the back end of the base than to front end of the base. In a third aspect the receiver has a flex joint attached to the flexible base which allows the receiver to deflect when the tee is struck by a bat. The flex joint may be formed via a tube receiver section joined to the flexible base at a location where the thickness of the base is reduced.

In another aspect, the base has a front section, a receiver section, and a back section. The back section may be angled so that the base has the shape of a home plate. The front section has a first thickness. At least a portion of the receiver section has a second thickness less than the first thickness. The back section has a third thickness greater than the first thickness of the front section. As a result, the front section is highly flexible, the receiver can flex forwardly relative to the plane of the base when the tee is struck by a bat, and the back section may act as a counterweight.

Other objects and advantages will become apparent from the following detailed description.

BRIEF DESCRIPTION OF THE DRAWINGS

In the drawings, the same element number indicates the same element in each of the views.

DETAILED DESCRIPTION OF THE DRAWINGS

Figure 1:
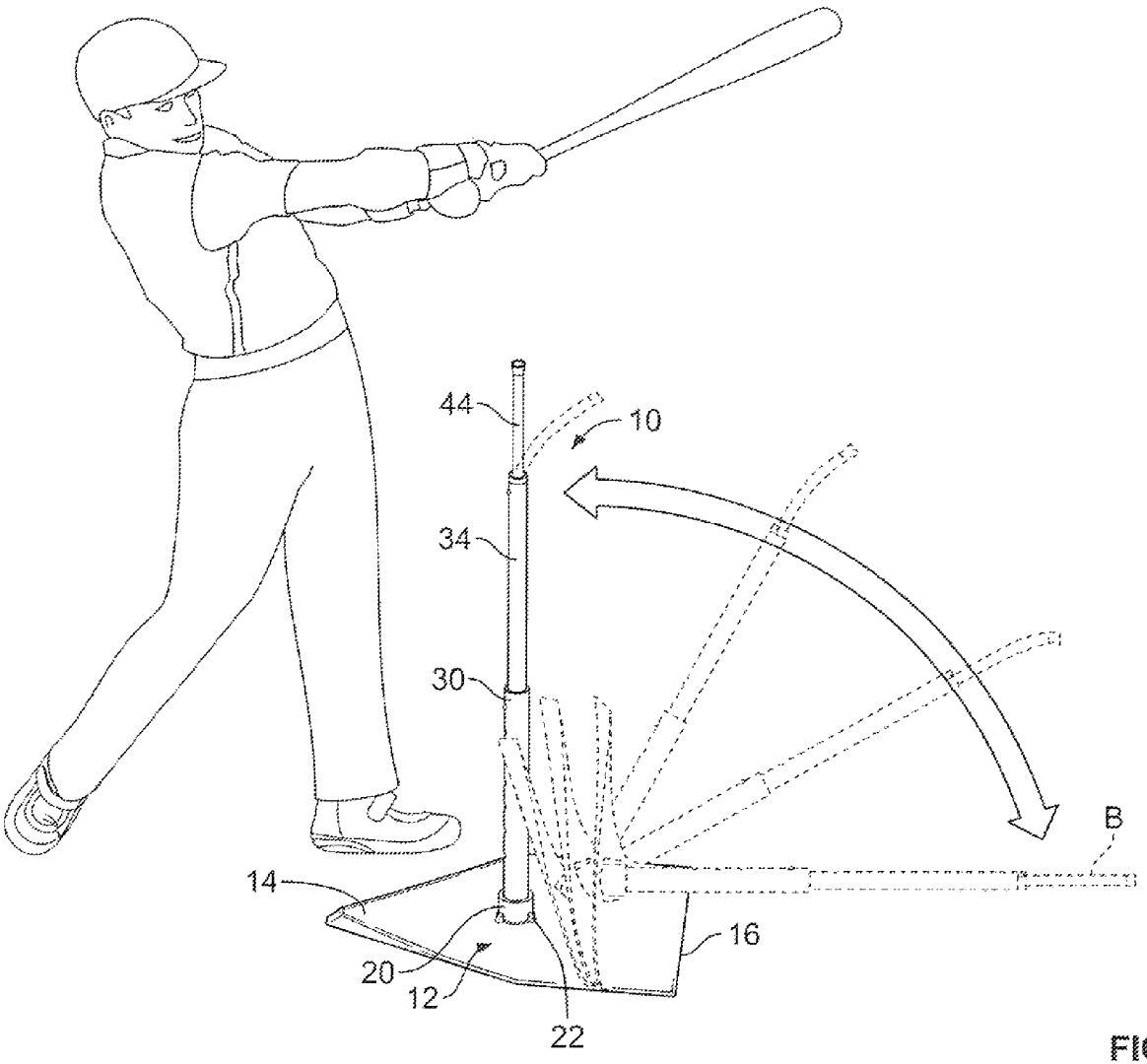
FIG. 1 is a perspective view of the new batting tee in use.

Turning now to the drawings, as shown in FIG. 1, batting practice tee 10 includes a base or mat 12. The base 12 may have a straight front end 16 and an angled back end 14, with the base 12 shaped like a home plate as used in baseball. A receiver 20 is attached to or formed integral with the base 12. The section of the base 12 from the receiver 20 to the front end 16 is a flexible material, such as rubber. Typically, the entire base 12 and the receiver may be molded as a single rubber piece. The receiver 20 may be hollow cylindrical tube section extending upwardly perpendicularly from the top surface of the base 12. The receiver 20 may flex or bend forward under load, towards the front end 16 of the base, for example when the tee 10 is hit by a bat. The connection or interface between the receiver 20 and the base 12 may form a flex joint to allow the receiver to flex or bend forward. The flex joint may be formed by varying the thickness of material of the base 12 around or in front of the receiver 20, and/or by varying the wall thickness at different areas of the receiver. Gussets 22 may be used to adjust the bending stiffness of the receiver.

Figure 2:
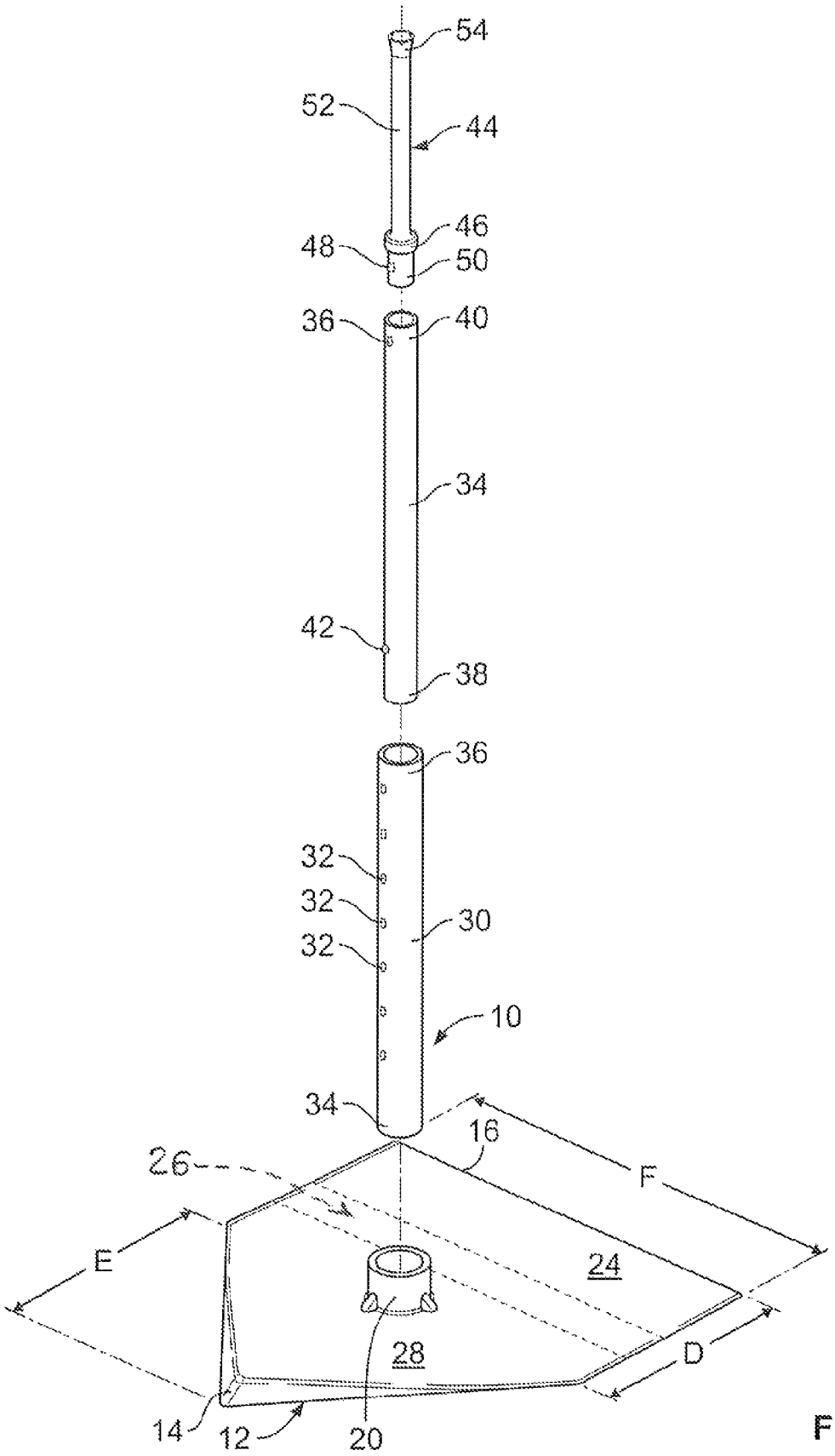
FIG. 2 is an exploded perspective view of the batting tee shown in FIG. 1.
Figure 4:
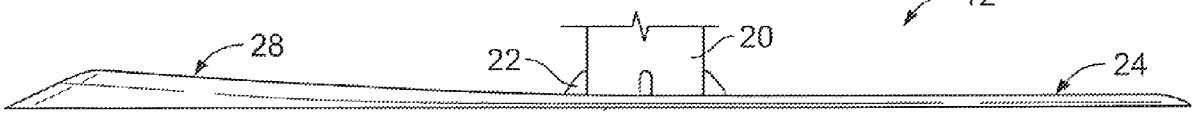
FIG. 4 is an enlarged side view of the base.

As shown in FIGS. 2 and 4, the base 12 may have a front section 24 having a first thickness, a flex or hinge section 26 having a second thickness, and a back section 28 having a third thickness. The lateral dotted lines in FIG. 2 generally designate the three sections, although the relative size and dimensions of each section may of course vary. Where the base 12 is provided as a single molded rubber or plastic piece, the changes in thickness may occur gradually over thickness transition areas between the three sections, with no visible section demarcation lines present. The thickness of the back section 28 may ramp up towards the rear, to a maximum of up to 2, 3, 4 or 5 times the thickness of the front section. In a typical design, the front section may have first thickness of about 2-6 mm (0.08-0.24 inches) and the back section having a maximum thickness of about 8 to 25 mm (0.31-0.98 inches). Weight elements may be added to the back section, internally or externally. For example, a metal plate may be molded into the back section.

The flex section 26 may have a thickness similar to, or less than, the thickness of the front section. The thickness of each section may be constant across the base 12 (in the direction of dimension F in FIG. 2) while varying in the front to back direction. The flex section 26 may be made thinner than the front and rear sections by reducing the material thickness from the top surface down, or from the bottom surface up, or both. While FIG. 2 shows a rectangular flex section formed in the bottom surface of the base 12 starting a few centimeters in front of the receiver 20, the flex section 26 may be provided in other different shapes, and may be offset from the receiver 20 in the front to back direction by varying dimensions. The flex section 26, for example, may be provided in a semicircular or other curved shape extending forward (toward the front edge 16) of the base 12.

The variation in thickness of the base 12 helps to make the front area 24 of the base 12 more flexible, while also making the back area 28 of the base heavier. These characteristics make the tee 10 less prone to fall over when hit by a bat. In addition, they provide a self-righting or bounce-back action, which causes the tee 10 to return to its upright position. This occurs because the flex joint between the receiver 20 and the base 12 (shown here in the form of the flex section 26), and the front section 24 of the base, may use elastic material forces tending to return the receiver to its original upright position. At the same time, the heavier back end of the base 12 exerts a moment tending to return the base 12 to its original flat position, as shown in dotted lines in FIG. 1.

Referring now to FIGS. 1 and 2, the receiver may be centered at a position closer to the back end of the base 12 than to the front end 16. In the example shown in FIG. 2, dimension D may be e.g., 19.0 cm (7.5 inches) and dimension E may be 17.8 cm (7 inches). Locating the receiver 20 closer to the back of the base 12 reduces the tendency of the tee 10 fall over forward when hit by a bat. Dimension F shown in FIG. 2 may be about 35.6 cm (14 inches). Dimensions D, E and F may be varied as desired or proportionally scaled up or down.

As shown in FIG. 2, a lower or base tube 30 has spaced apart positioning holes 32 along one side. The lower end 34 of the base tube 30 is sized and shaped to fit into the receiver 20 with a friction fit. In other words, the lower end 34 of the base tube 30 may be pushed into the receiver 20 with nominal hand force. The base tube 30 is held in place in the receiver via friction, and optionally elastic compression forces of the receiver.

A projection 42 may be provided at the lower end 38 of an upper tube 34. The lower end 38 of the upper tube 34 is sized and shaped to fit into the upper end 36 of the base tube 30 also with a friction fit or a sliding fit. The projection 42 is adapted to fit into one of the holes 32, to set the relative positions of the base and the upper tubes, which adjusts the height of the tee 10. The base tube and the upper tube may be a generally rigid material, such as a hard plastic.

Figure 3:
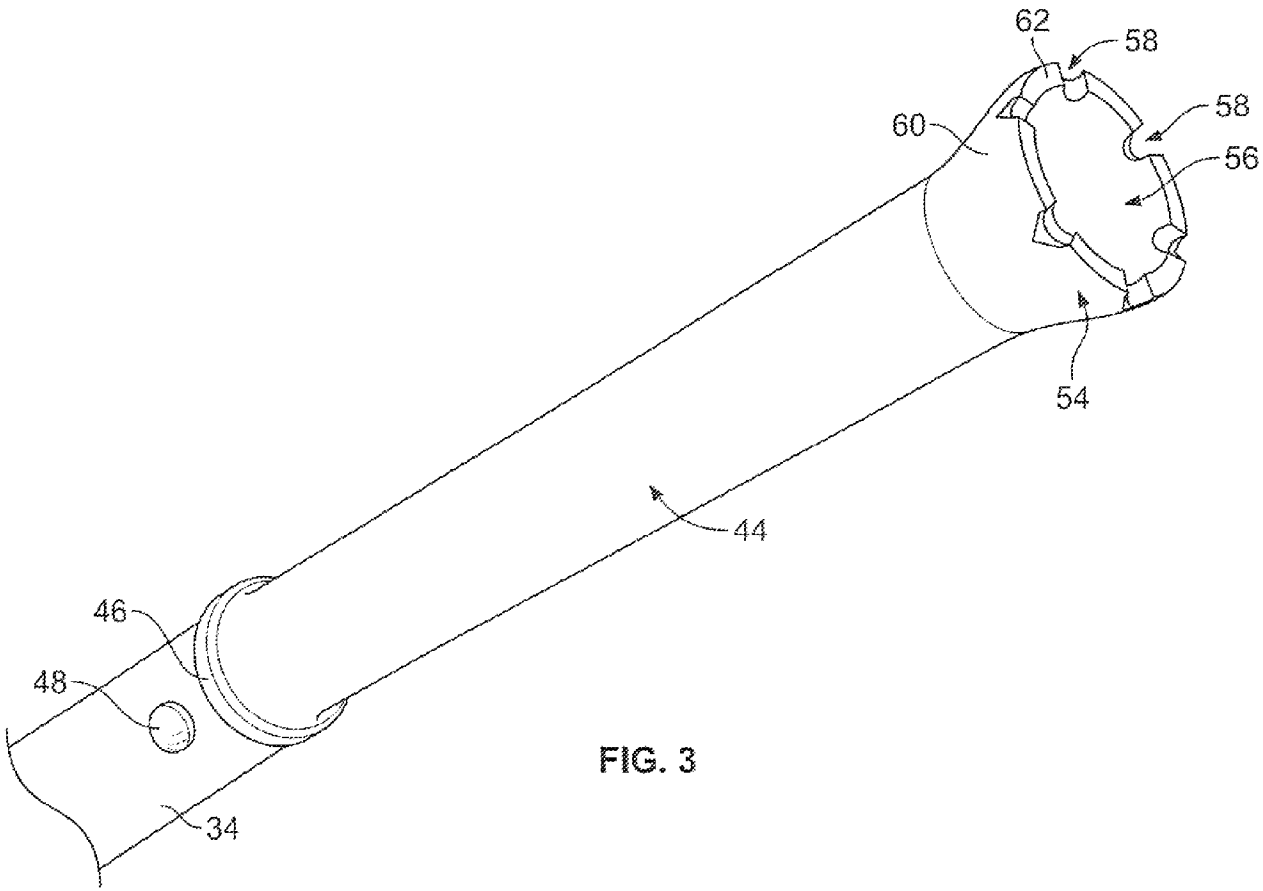
FIG. 3 is an enlarged perspective end view of the ball holder shown in FIGS. 1 and 2.

A ball holder 44 may have a cup 54 at the top end and a cylindrical body 52 extending to a collar 46. A projection 48 may be provided on the lower end 50 of the ball holder 44, below the collar 46. Turning now to FIG. 3, the cup 54 may be provided with outwardly flared wall segments 60 spaced apart by notches 58, and a recess 56 extending into the cup 54. In use the ball rests on top surfaces 62 of the wall segments 60. Referring still to FIG. 3, the lower end 50 of the ball holder 44 is sized and dimensioned to slide into the upper end 40 of the upper tube 34. The projection 48 is located to align with, and project into a hole 36 at the upper end 40 of the upper tuber 34, just as the collar 46 comes to rest on top of the upper tube 34.

The ball holder 44 may tightly fit into the upper tube 34, with the fit between them, and the projection 36 tending to keep the ball holder 44 attached to the upper tube 34 even when struck by a bat. The ball holder 44 may be made of flexible resilient material, such as rubber. As shown in dotted lines in FIG. 1, if the ball holder is a flexible material, it can bend forward upon being struck by a bat. This absorbs impact energy. The tee 10 is consequently less likely to fall over or be displaced.

The ball holder 52 is shorter than, and has a smaller diameter than, the base tube or the upper tube. Typically, the length of the ball holder from the top of the collar 46 to top of the cup 54 is about 10-20 cm (4-8 inches) or 13-18 cm (5-7 inches). The relatively smaller diameter of the cup 54 allows the tee 10 to be used with balls of varying diameter. For example, the inner diameter formed by the surfaces 62 may range from about 15 to 40 mm (0.6 to about 1.5 inches).

The tee 10 may be provided un-assembled, with the base 12, the base tube 14, the upper tube 34 and the ball holder 44 separated from each other. This allows the tee to more easily stored and transported in a compact size. In use, the base 12 may be placed on the ground and the base tube 30 pressed by hand into the receiver 20. The upper tube 34 is then pushed into the upper end 36 of the base tube 30, until the desired combined height of both tubes is reached. The upper tube 34 can then be turned or manipulated to move the projection 42 into the closest hole 32. The ball holder 44 is then pushed into the open top end 40 of the upper tube 34. The ball holder 44 is manipulated to move the projection 48, if used, so that it projects into the hole 36 at the upper end 40 of the upper tube 34.

A ball is placed on the cup 54. The tee 10 is then ready for batting practice. If the bat hits ball holder 44, the body 52 of the ball holder 44 may have enough flexure to absorb the impact with minimal movement of the rest of the tee. Depending on the strength and location of the impact of the bat however, the upper and base tubes may also be driven forward. Referring to the dotted lines in FIG. 1, when this occurs, the upper and base tubes remain substantially straight, since they are a substantially rigid material. The impact of the bat not absorbed by the holder 44 is then largely absorbed at the base 12. The back end 14 of the base 12 may lift up off of the ground while the tee 10 tips momentarily forward. As shown in dotted lines in FIG. 1, the back section 28 and the receiver 20 may rotate forward with the flex section bending through 90°, if necessary, until the ball holder stops upon contact with the ground. The front section 24 may simultaneously bend and rotate forward, but to a lesser extent, and with the front edge 16 typically remaining stationery. Alternatively, depending on the specific design of the flex section 26 and with a less severe bat impact, the front section 24 may remain largely flat on the ground, with little or no flexing of the front section 24.

In addition, the receiver may flex or bend forward on the base 12. This may occur with a temporary deformation of the flexible or resilient material of the receiver 20 and the surrounding material of the base 12. The flexing of the receiver 20, the base 12, and the greater weight of the back area of the base 12 help to allow the tee 10 to absorb the impact of the bat, without causing the tee 10 to fall over and remain in a horizontal position.

Referring still to FIG. 1, a highly forceful impact may cause the tee 10 to lean over to the position indicated by at B. However, with the tee 10 in position B, the elastic or spring-like forces in the front area of the base 12, and the similar forces in the receiver 20, then tend to move the tee back into the upright position as shown in solid lines in FIG. 1. The weight of the back area of the base 12 also exerts a force tending to move the tee back to the upright position. Consequently, the tee tends to automatically return to the upright position. Depending on the specific design parameters used, the tee 10 may even automatically revert to the upright position even with the ball holder touching the ground.

Thus, a novel batting tee has been shown and described. Various changes and substitutions can of course be made without departing from the spirit and scope of the invention. The invention, therefore, should not be limited except to the following claims, and their equivalents.

The invention claimed is:

1. A batting practice ball holder comprising:

a flexible base having a front section joined to a flex section, and a back section joined to the flex section, and with the flex section having a thickness less than the back section;

a receiver attached to the back section of the flexible base, with the receiver able to flex forward towards a front section of the base;

a substantially rigid first tube having a first and a second end, with the first end attachable to the receiver;

a substantially rigid second tube having a first end and a second end, with the first end of the second tube attachable to the second end of the first tube, and with the first and second tubes together having an adjustable length;

a flexible ball holder having a first end and a second end, with the first end attachable to the second end of the second tube; and a cup at the first end of the ball holder, with the cup adapted for holding a spherical ball.

2. The batting practice ball holder of claim 1 with the flex section having a length, in a front to back direction, less than front section and the back section.

3. The batting practice ball holder of claim 2 wherein the receiver and the base comprise a single piece integral unit.

4. The batting practice ball holder of claim 1 wherein the flex section has a thickness less than the front section.

5. The batting practice ball holder of claim 1 wherein the flex section comprises a rectangular prism extending widthwise across the base.

6. The batting practice ball holder of claim 1 wherein the back section has two converging equal length sides and the front section has straight front edge.

7. The batting practice ball holder of claim 1 wherein the base has a center of gravity located between the receiver and a back end of the base.

8. The batting practice ball holder of claim 1 with a plurality of spaced apart holes in one of the tubes and a projection on the other of the tubes, with the projection adapted to fit into one of the spaced apart holes.

9. The batting practice ball holder of claim 1 with the first tube inserted into the receiver with a friction fit, and with the second tube inserted into the first tube with a friction fit, and with the ball holder inserted into the second tube with a friction fit.

10. A ball batting tee comprising:

a flexible base having a front end and a back end, and with the base having a higher flexibility section between the front end and the back end, with the higher flexibility section having a thickness less than any other section of the base, and the base having a center of gravity closer to the back end than to the front end;

a receiver attached to the base with the receiver ordinarily substantially perpendicular to the base and with the higher flexibility section allowing the receiver to bend forward relative to front end of the base;

a substantially rigid first tube having an upper end and a lower end, with the lower end extending into the receiver;

a substantially rigid second tube having an upper end and a lower end, with the lower end of the second tube telescopically inserted into the upper end of the first tube;

a flexible ball holder having a lower end and an upper end, with the lower end inserted into the upper end of the second tube; and a cup at the upper end of the ball holder for holding a ball.

11. The ball batting tee of claim 10 with the flexible base having a straight front end and an angular back end and with the receiver closer to the back end than to the front end.

12. The ball batting tee of claim 10 with the receiver centered at a position on the base at or behind the center of gravity of the base.

13. The ball batting tee of claim 10 wherein the combined weight of the base and the receiver exceeds the combined weight of first tube, the second tube and the ball holder and wherein the center of gravity of the combined base, receiver, first tube, second tube and the ball holder is located between the center of the receiver and the back end of the base.

14. A batting practice ball tee comprising:

a flexible base having a flex section and a back section, and with the flex section having a thickness less than the back section;

a receiver attached on the base;

a first tube having a first and a second end, with the first end attachable to the receiver;

a second tube having a first end and a second end, with the first end of the second tube attachable to the second end of the first tube, and with the first and second tubes together having an adjustable combined length;

a flexible ball holder having a length greater than its diameter, a first end and a second end, with the first end attachable to the second end of the second tube; and a cup at the first end of the ball holder.

15. The batting practice ball tee of claim 14 with the flex section comprising a rectangular prism extending widthwise across the base.

16. The batting practice ball tee of claim 15 with the flexible base further including a front section, and with the flex section having a length, in a front to back direction, less than front section or the back section.

17. The batting practice ball tee of claim 14 with the flexible base having a front section and with the flex section having a thickness less than the front section.

18. The batting practice ball tee of claim 14 with the flexible ball holder having a diameter less than the diameter of the second tube.

19. The batting practice tee of claim 14 with flexible ball holder having a length of 10-20 cm.

* * * * *